United States Patent [19]

Fink, Jr.

[11] Patent Number: 4,596,278

[45] Date of Patent: Jun. 24, 1986

[54] BALANCED, TWO-STAGE POPPET VALVE FOR FUEL DISPENSING NOZZLE

[75] Inventor: Arthur C. Fink, Jr., Lonedell, Mo.

[73] Assignee: Husky Corporation, Pacific, Mo.

[21] Appl. No.: 787,015

[22] Filed: Oct. 11, 1985

Related U.S. Application Data

[63] Continuation of Ser. No. 731,451, May 6, 1985, abandoned, which is a continuation of Ser. No. 521,981, Aug. 11, 1983, abandoned.

[51] Int. Cl.[4] ..... B67D 5/373

[52] U.S. Cl. ..... 141/207; 141/392; 141/210

[58] Field of Search ..... 141/206–229, 141/192, 198, 339, 392; 137/801; 222/192

[56] References Cited

U.S. PATENT DOCUMENTS

| | | | |
|---|---|---|---|
| 3,042,083 | 7/1962 | Kruckeberg | 141/215 X |
| 3,088,500 | 5/1963 | Payne | 141/208 |
| 3,502,121 | 3/1970 | Moore et al. | 141/207 |
| 3,651,837 | 3/1972 | Murray | 141/225 |
| 3,817,285 | 5/1974 | Wilder et al. | 141/206 |

FOREIGN PATENT DOCUMENTS

| | | | |
|---|---|---|---|
| 2064481 | 6/1981 | United Kingdom | 141/206 |

OTHER PUBLICATIONS

Sketch of Dover Corp., poppet valve by OPW Division.

*Primary Examiner*—Stephen Marcus
*Assistant Examiner*—Ernest G. Cusick
*Attorney, Agent, or Firm*—Paul M. Denk

[57] ABSTRACT

A balanced, two-stage pressure poppet valve for a fuel dispensing nozzle is disclosed, with the valve controlling the dispensing of fuel. When the valve is closed, fluid pressure aids in holding the valve in its closed position and, upon effecting opening of the valve, a first valve member is opened thereby to dump the fuel pressure acting on the valve holding it closed immediately prior to opening of the main valve member so that only the biasing force of a spring (and not the fuel pressure forces) need be overcome to open the valve for fuel dispensing purposes. Further, a flexible flow stabilizer member is positioned downstream from the main valve so as to reduce turbulence in the flow path of the dispensing nozzle and to minimize flow and pressure surges. Also, an improved configuration of a check valve in the nozzle is disclosed.

4 Claims, 2 Drawing Figures

BALANCED, TWO-STAGE POPPET VALVE FOR FUEL DISPENSING NOZZLE

This is a continuation application of the application by the same inventor having Ser. No. 731,451, filed on May 6, 1985, now abandoned, which identified application is designated as continuation of the application having Ser. No. 521,981, filed on Aug. 11, 1983, now abandoned, all of said applications owned by a common assignee.

BACKGROUND OF THE INVENTION

This invention relates to a fuel dispensing nozzle, such as may be utilized to dispense a variety of liquid fuels (e.g., gasoline, diesel fuel and the like), and particularly to such a fuel dispensing nozzle which automatically shuts off the flow of fluid upon the fuel tank of the vehicle becoming filled.

Such automatically operable fuel dispensing nozzles are in wide commercial use and have long been known in the art. Reference may be made to such co-assigned U.S. Pat. Nos. 4,016,910 and 4,031,930 for more complete disclosures of automatically operable shut-off fuel dispensing nozzles. Generally, these automatic fuel dispensing nozzles have a main poppet valve which is operable upon actuating a dispenser handle which in turn is pivotally attached to the nozzle. Upon actuating the handle, a stem extending exteriorally of the dispensing nozzle housing is displaced axially into the housing so as to move a poppet valve member from its closed position in which it sealingly engages a valve seat thereby to permit the flow of fuel through the dispensing nozzle and into the fuel tank of an automobile or the like. As is conventional, these automatic shut-off fuel dispensing nozzles include a diaphragm actuator or the like which is responsive to the fuel level in the tank reaching the end of the dispensing spout of the nozzle and covering up a vent hole thereby preventing communication between one side of the diaphragm actuator and the atmosphere in which case a vacuum generated by the flow of fuel through the dispensing nozzle causes the front pivot or fulcrum for the dispensing handle to be released which in turn moves the handle out of engagement with the poppet valve stem, thus allowing the poppet valve to close terminating the flow of fuel from the nozzle.

Various poppet valve configurations are currently used in existing fuel dispensing nozzles. Typically, these poppet valves are complex members requiring considerable machining and are thus difficult to assemble and expensive to manufacture. Also, in some instances, prior art poppet valves have been known to permit vacuum to develop within various component parts of the valve or to permit air to enter the poppet valve, thus having a cushioning effect on the operation of the valve so that the dispensing nozzle will not instantaneously terminate the flow of fluid or may cause a jumping action in the valve's operation, resulting in erractic flow of fuel which may have a deleterious effect on metering of the flow of fuel.

Reference may be made to such U.S. Pat. Nos. 3,273,609, 3,653,415, 4,199,012, 4,139,032, 4,139,032, 4,196,759, 4,203,478, 3,196,908, 3,085,600, and 3,877,480, for disclosures of automatic shut-off dispensing nozzles having a variety of poppet valve configurations generally in the broad field of this invention.

Further, reference may also be made to the patentee's co-assigned U.S. Pat. No. 4,397,447, issued Aug. 9, 1983, which discloses an improved poppet valve construction for an automatic shut-off fuel dispensing nozzle.

While these prior art patents disclose a variety of poppet and other type valves for controlling the flow of fuel through the dispensing nozzle, and while many of these valves worked well for their intended purposes, many of these prior valves did have certain shortcomings. More particularly, since it was desirable to have relatively fast flow rates of fuel through the dispensing nozzle, relatively large diameter poppet valves were required so as to ensure a substantially unimpeded flow of fuel through the dispensing nozzle when the dispensing nozzle handle was actuated. However, to ensure that the flow of fuel was positively blocked when the valve was closed, such a large area poppet valves required a relatively strong spring to ensure that the valve remained in its closed position without leakage. These strong valve biasing springs required considerable effort to overcome upon actuating the dispensing nozzle handle which may be uncomfortable for the user.

Further, many of the prior art poppet valves were relatively complex in construction and were difficult to fabricate, to install, and to service in the field.

SUMMARY OF THE INVENTION

Among the several objects and features of this invention will be noted the provision of a balanced, two-stage pressure poppet valve for an automatic shut-off fuel dispensing nozzle which utilizes fuel pressure in combination with the biasing spring so as to positively maintain the valve in its closed position when the dispensing nozzle is unactuated;

The provision of such a balanced, two-stage pressure poppet valve in which the fuel pressure aiding the spring in holding the valve closed is dumped incipiently upon opening the valve so that the user need only overcome the bias of a relatively low spring constant biasing spring;

The provision of such a balanced, two-stage pressure poppet valve which, when open, allows fuel to flow freely around the poppet valve;

The provision of such a balanced, two-stage pressure poppet valve which significantly controls turbulence within the fuel dispensing nozzle downstream from the poppet valve seat at all flow rates thereby substantially preventing vacuum and flow surges;

The provision of an automatic shut-off fuel dispensing nozzle in which increased fuel flow through the venturi of the valve is facilitated such that a uniform vacuum could be obtained throughout the entire fuel flow rate ranges of the dispensing nozzle; and The provision of such a balanced, two-stage pressure poppet valve for a fuel dispensing nozzle which is of simple construction, which is reliable in operation, and which effectively closes the dispensing nozzle blocking the flow of fuel therethrough when closed.

Other objects and features of this invention will be in part apparent and in part pointed out hereinafter.

Briefly stated, in a fuel dispensing nozzle of the present invention, the nozzle has a housing with the latter having a fuel flow passage extending therethrough from a fuel inlet to a fuel outlet or spout. A valve seat is provided within the housing constituting a part of the fuel flow passage between the inlet and the outlet. A poppet valve member is movable within the housing between a closed position in which it sealingly engages the valve seat so as to block the flow of fuel, and an open position thereby to permit the flow of fuel through the flow passage. The valve has a stem extending exteriorally of the housing. The nozzle further has a manually movable handle pivotally supported relative to the housing and movable between an off position in which the poppet valve is closed, and an on position in which the handle is in engagement with the poppet valve stem thereby to effect movement of the poppet valve from its closed position. Even more specifically, the poppet valve comprises a main poppet valve body having a sliding sealing fit with a portion of the housing as the poppet valve member moves between its opened and closed positions. A main seal is carried by the main poppet valve body sealingly mating with the valve seat within the housing when the poppet valve is closed. A spring biases the main poppet valve member toward its closed position. A so-called weep port is provided in the main poppet valve member providing communication between the portion of the flow path upstream from the valve seat when the poppet valve is closed and the interior of the main poppet valve body so that fluid pressure within the main poppet valve body cooperates with the spring thereby to hold the main poppet valve member in its closed position. The main poppet valve body further has a vent passage between the inside of the main poppet valve body and a portion of the flow path downstream from the valve seat. Further, a so-called dump valve is positioned within the main poppet valve body, this dump valve being biased toward a closed position so as to block the vent passage. The poppet valve stem, upon movement thereof by the handle, is operable to first move the dump valve from its closed position thereby to vent fuel from within the main poppet valve body such that only the biasing force of the spring maintains the poppet valve body in its closed position. Further, after fluid within the poppet valve body has been vented, the stem moves the main poppet valve body clear of the valve seat against the bias of only the spring.

BRIEF DESCRIPTION OF THE DRAWINGS

Corresponding reference characters indicate corresponding parts throughout the several views of the drawings.

DESCRIPTION OF PREFERRED EMBODIMENTS

Figures 1, 2:
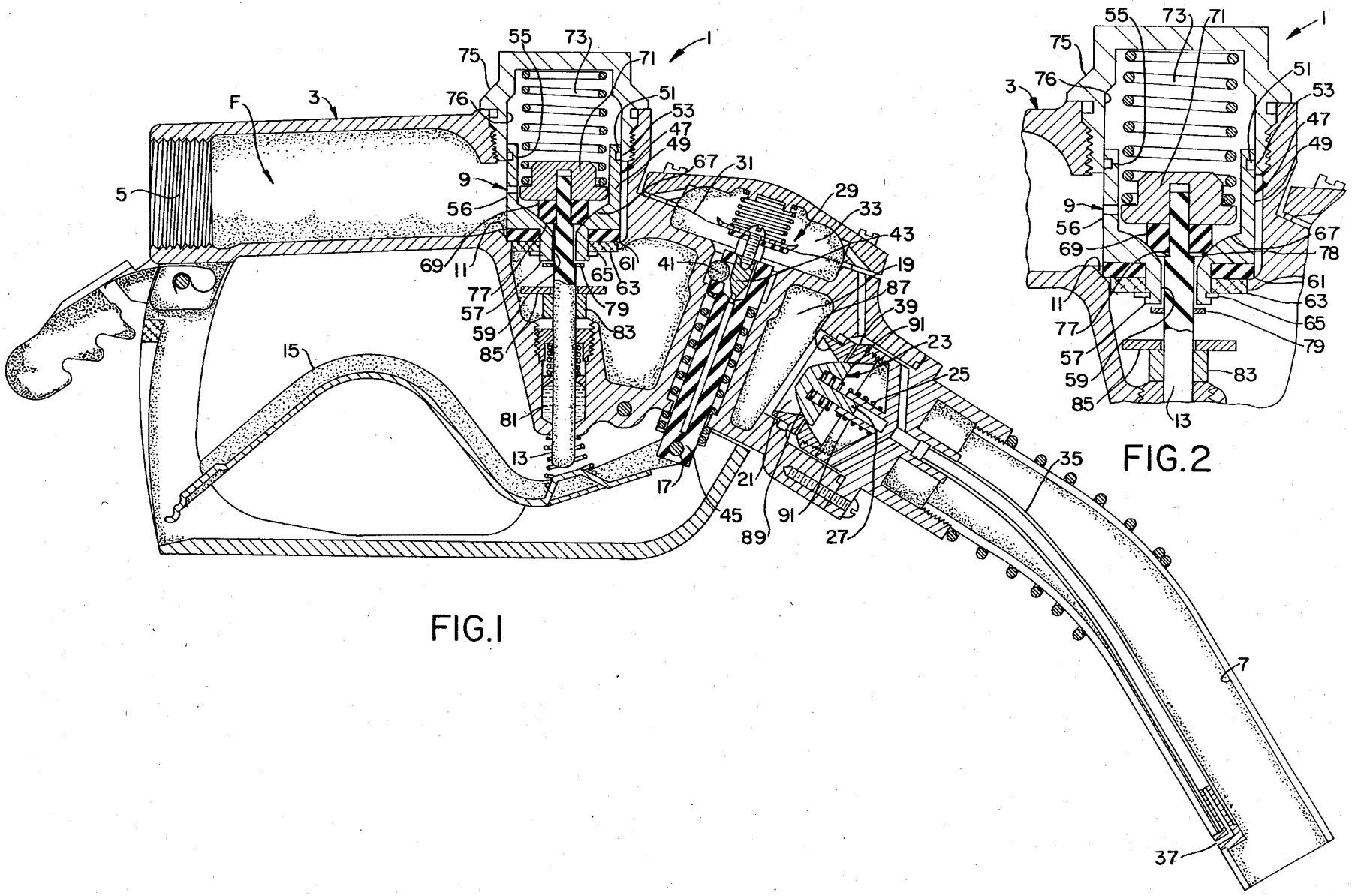
FIG. 1 is a vertical cross sectional view of an automatic shut-off fuel dispensing nozzle of the present invention.
FIG. 2 is an enlargement of a portion of the dispensing nozzle of FIG. 1 showing a balanced, two-stage poppet valve of the present invention.

Referring now to the drawing, an automatic shut-off fuel dispensing nozzle of the present invention is indicated in its entirety by reference character 1. The nozzle is shown to have a housing 3 of cast aluminum, or other suitable material, having a fluid flow passage F therethrough, with the flow passage having an inlet 5 and an outlet 7. It will be appreciated that inlet 5 is provided with internal threads so that the dispensing nozzle may be threaded on a dispensing hose or the like (not shown). As will be hereinafter explained in greater detail, a balanced, two-stage pressure poppet valve assembly, as generally indicated at 9, is disposed within housing 3 and is cooperable with a valve seat 11 within the flow passage for movement between a closed position (as shown in FIG. 1) in which the poppet valve blocks the flow of fuel through the dispensing nozzle and an open or raised position (not shown) in which the poppet valve member is clear of valve seat 11 so as to permit the flow of fuel from inlet 5 to spout 7. Thus, poppet valve 9 constitutes a control valve for the nozzle.

An axially movable stem 13 is provided which extends exteriorally of housing 3. This stem is engagable by a handle 15 pivotally attached to the dispensing nozzle, as indicated at 17, for effecting opening of poppet valve 9 so as to permit the selective dispensing of fuel at various flow rates, depending on the distance poppet valve 9 is displaced from its seat 11.

Housing 3 further includes a so-called main body cavity, as indicated at 19, downstream from valve seat 11 into which the fuel flows upon passing through the valve seat. The fuel exits the main body cavity into a venturi, as generally indicated at 21, before it enters the upper end of outlet spout 7. A normally closed check valve 23 is provided in venturi 21 and the check valve is biased toward its closed position by means of a compression coil spring 25 and the check valve is maintained centered with respect to the venturi by means of a guide 27. The normally closed check valve prevents the leaking of fuel from main body cavity 19 upon closing of poppet valve 9. It will be appreciated that upon opening of poppet valve 9, fuel pressure within main body cavity 19 forces the check valve open against the bias of spring 25 and permits the fuel to be dispensed from the nozzle.

As is conventional, means, as generally indicated at 29, is provided for automatically terminating the flow of fuel from dispensing nozzle 1 in the event the container or fuel tank into which the fuel is being dispensed becomes filled up to the level of the lower end of dispensing spout 7. This automatic shut-off means includes a diaphragm actuator, as indicated at 31, which effects the release of the plunger carrying fulcrum or pivot point 17 for handle 15 which in turn releases stem 13 so that the poppet valve 9 of the present invention will return to its normally closed position under the bias of its spring thus blocking the flow of fuel.

More particularly, a so-called atmospheric pressure chamber 33 is provided in housing 3 on one side of the diaphragm actuator 31, and this atmospheric chamber is in communication with the atmosphere by means of a series of passageways within the housing 3 which in turn are in communication with a vent tube 35 extending substantially lengthwise of spout 7 to a vent port 37 proximate the outer end of spout 7. A plurality of so-called vacuum ports 39 are provided in venturi 31 and are in communication with the passages in communication with vent tube 35 for purposes as will appear. A plurality of detent balls 41 cooperate with a movable tapered pin 43 which in turn is carried by a plunger 45, the lower end of the plunger having handle 15 pivotally attached thereto by fulcrum pin 17. Normally, diaphragm chamber 33 is vented to the atmosphere by vent tube 35. As long as the vent tube and vent 37 are open (i.e., uncovered by fuel on the outside of spout 7), the vacuum in chamber 33 will be broken and diaphragm actuator 31 will maintain detent balls 41 in their position shown in FIG. 1, permitting stem 13 to be moved axially inwardly of housing 3 upon the user moving handle 15 toward the housing. However, if the fuel level in the fuel tank of the vehicle rises so as to cover vent port 37, air will be prevented from entering vent tube 35 and the vacuum within chamber 33 will cause the diaphragm actuator 31 to raise pin 43 which in turn will release detent balls 41. Then, plunger 45 will move outwardly moving pivot pin 17 which in turn releases stem 13 and permits poppet valve 9 of the present invention to be automatically returned to its closed position blocking the flow of fuel through the dispensing nozzle. Generally, the construction and operation of the automatic shut-off features of this valve are well known by those skilled in the art.

Referring now in detail to the balanced, two-stage pressure poppet valve 9 of the present invention, the valve is shown to include a cup-shaped, main poppet valve body, as generally indicated at 47, having an outer cylindrical wall 49. A groove 51 is provided in the upper end of the outer cylindrical wall of the main poppet valve body and an O-ring seal 53 is fitted within this groove. Thus, main poppet valve body has a sliding, sealing fit within a portion of housing 3 as the poppet valve moves within the housing between its opened and closed positions. It will be appreciated that O-ring 53 prevents communication between the portion of flow passage F upstream from valve seat 11, and the interior of the main poppet valve body 47. The poppet valve body further has a generally cylindric inner wall 55 and a small diameter weep hole 56 extends through the walls of the main poppet body so as to permit pressurized fuel within flow passage F upstsream from valve seat 11 to fill the interior of the main poppet valve body 47 for purposes as will appear.

Main poppet valve body 47 further has a central boss 57 on its bottom end with a center opening 59 extending coaxially through central boss 57 thus providing communication between the interior of the cup-shaped main poppet valve body and the portion of flow passage F downstream from valve seat 11 when the poppet valve 9 is in its closed position. An elastomeric main poppet valve seal member 61 is fitted onto the bottom end of the main poppet valve member so as to surround central boss 57, and this seal member is retained in place by a retaining plate 63, which in turn is secured to central boss 57 by means of a snap ring 65. It will be appreciated that seal member 61 is sealably engagable with valve seat 11 when poppet valve 9 is in its closed position thereby to sealingly block the flow of fluid past valve seat 11.

Further, main poppet valve body 47 is provided with a tapered wall 67 on its bottom, inside face converging inwardly and downwardly toward center opening 59. As shown, center opening 59 is of a somewhat larger cross section than the diameter of stem 13 received therewithin and extending upwardly into the main poppet valve body 47 so as to permit the flow of fluid within the annular space between the exterior of the stem and the portion of boss 57 defining center opening 59. An elastomeric dump valve member 69 is positioned on the upper side of tapered wall 67, and the bottom face of this dump valve member 69 sealingly mates with tapered wall 67 thereby to block the flow of fluid from the inside of main poppet valve body 47 to main cavity 19 when the dump valve member is in its closed position. A so-called nut 71 is received on the upper end of stem 13 and the bottom face of nut 71 engages dump valve member 69. A compression coil spring 73 is interposed between the upper face of nut 71 and the inner face of a screwed-in-place cover 75 which constitutes a removable portion of housing 3. This cover includes an inner cylindric wall 76 which sealingly, slidingly receives the outer cylindric wall 49 of the main poppet valve body 47 as the latter moves between its closed and its opened positions. It will be appreciated that spring 73 exerts a compressive closing force on dump valve member 69 via nut 71 so as to prevent the escape of fluid from the interior of the main poppet valve body 47, and further transmits the compressive biasing force of spring 73 to the portions of main poppet seal member 61 sealingly engageable valve seat 11. Thus, spring 73 includes the double function of sealing dump valve 69 relative to inner tapered wall 67 and sealing member 61 relative to valve seat 11 when poppet valve 9 is in its closed position.

As will be appreciated, with poppet valve 9 closed, relatively high pressure fluid (fuel) is present within the portion of flow passage F on the inlet side of valve seat 11. This pressurized fluid is permitted to flow into the interior of main poppet valve body 47 by means of weep hole 56 such that the pressurized fluid on the inside of the poppet valve body cooperates with the biasing force of spring 63 so as to positively hold the poppet valve member in its closed position in sealing engagement with valve seat 11. In this manner, it will be recognized that the poppet valve 9 need not depend on the biasing force of spring 73 alone so as to positively maintain the poppet valve in its closed position.

Further in accordance with this invention, a shoulder 77 is provided on the upper end of stem 13 which in turn carries a washer 78 in engagement with the lower face of dump valve member 69 so that upon upward axial movement of stem 13, dump valve member 69 is moved upwardly against the bias of spring 63 thereby to open communication between the interior of the main poppet valve member 47 and main body chamber 19 downstream from valve seat 11 so as to dump the pressurized fluid from the inside of the valve member. Further, an E-shaped snap ring 79 is installed on stem 13 below the bottom end of center boss 57 a predetermined distance so that after dump valve member 69 has been moved upwardly away from its respective valve seat and so that after fluid pressure from within main poppet valve body 47 has been dumped, the snap ring will engage the bottom of the main poppet valve body member 47 and begin to move the poppet valve member upwardly solely against the biasing force of spring 73. In this manner, it will be appreciated that since the fluid pressure forces acting on the poppet valve member holding it in its closed position is released first, the operator need only overcome the biasing force of spring 73 to open poppet valve 9 and to hold it in its opened position. It will further be understood that because snap ring 79 is disposed somewhat below the bottom of center boss 57 when the dispensing nozzle is in its off position, this allows for a slight amount of "lost motion" permitting the dump valve member 69 to be incipiently opened and further permitting dumping of the pressurized fluid prior to axial compression of spring 73 by means of snap ring 79 on stem 13 engaging main poppet valve member. With the E-shaped snap ring in engagement with the bottom of boss 57, fuel is not sealed within the poppet valve and is free to be discharged via opening 59. Additionally, a packing gland and nut 81 surrounds stem 13 in the conventional manner so as to allow sliding sealing movement of the stem without leakage of fluid therefrom.

Further in accordance with this invention, means is provided within cavity 19 to stabilize the flow of fluid entering cavity 19 past valve seat 11 so as to reduce flow turbulence within chamber 19 thereby to essentially eliminate or reduce pressure and vacuum surges, and to result in uniform metered delivery of the fuel substantially throughout the entire flow rate range of the dispensing nozzle. More specifically, this flow stabilizing means is shown to comprise a spacer 83 received on stem 13 above packing gland 81, and a washer or ring 85 received on stem 13 generally concentrically with and downstream from valve seat 11 so that as poppet valve 9 moves from its closed to its opened position, pressurized fuel flowing past the valve seat first encounters flexible disc 85 thus substantially uniformly distributing the flow of fluid within cavity 19.

Further in accordance with this invention, venturi 21 has a converging section 87 facing upstream toward valve seat 11 for receiving fuel from within main body cavity 19. This converging venturi section 87 leads to a throat 89 which in turn empties into a diverging section 91. It will be appreciated that vacuum ports 39 are disposed slightly downstream from throat 89.

It will be particularly noted in the drawings that check valve 23 is configured in such manner that the upstream facing end of the check valve is generally rounded so as to enhance the flow of fluid from main body cavity 19 into spout 7 in such manner as to minimize turbulence. Further, it will be noted that when check valve 23 is in its closed position, the maximum diameter of the check valve body is only slightly larger in cross section than the diameter of throat 89 so as to minimize the maximum outer diameter of the check valve body. This substantially increases the flow of fuel through the venturi and around the check valve at given pressure differentials. Further, by so configuring the shape of check valve member 23 in accordance with this invention, as described above, the spring force required by check valve biasing spring 25 can be significantly reduced thereby permitting the check valve to be opened more readily upon opening of poppet valve 9, and yet ensuring that fuel does not leak from within chamber 19 when the dispensing nozzle of the present invention is in its off position. For example, it has been found that for flow dispensing nozzles of comparable designs, the flow dispensing nozzle of the present invention having check valve member 23 installed therein configured as shown in FIG. 1 and as described therein requires a biasing spring 25 for the check valve exerting only about two-thirds of the biasing force of similar size conventional dispensing nozzles. Also, because of flow deflector washer 85, of the converging venturi inlet 87, and of check valve configuration 23, the dispensing nozzle 1 of this invention is substantially more efficient in permitting higher flows of fuel therethrough with lower pressure drops and pumping power required.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. In a fuel dispensing nozzle having a housing, the latter having a fuel flow passage therethrough from a fuel inlet to a fuel outlet, a valve seat within said housing constituting a part of said fuel flow passage between said inlet and said outlet, a poppet valve movable between a closed position in which it sealingly engages said valve seat to block the flow of fuel therethrough, and in open position thereby to permit the flow of fuel through said fuel flow passage, said poppet valve cooperating with a stem that extends from within the poppet valve and exteriorly of said housing, said nozzle further having a manually movable handle pivotally supported relative to said housing, and being movable between an off position in which said poppet valve is in its closed position and an on position in which said handle is in engagement with said stem thereby to effect movement of said poppet valve from its closed position, wherein the improvement comprises: the poppet valve having a sliding sealing fit with respect to a portion of said housing as said poppet valve moves between its opened and closed positions, the poppet valve formed of a cylindrical member having a hollow interior and generally having inner and outer cylindrical walls, said cylindrical member having a bottom, the bottom of the cylindrical member integrally formed having a downwardly converging tapered wall, a central boss means formed at the lower portion of the tapered wall extending downwardly therefrom and designed for cooperating with the stem, there being a central opening formed through the boss means, and said stem at its upper end extending through the boss means central opening and into the hollow cylindrical interior of the poppet valve, and said stem at its downward end extending below the poppet valve thereof, a first seal carried by said poppet valve central boss means and sealingly mating with said valve seat when said poppet valve is closed, a spring biasing said poppet valve towards its closed position, a weep port in said poppet valve through its cylindrical member and providing communication between that portion of said flow path upstream from said valve seat when said poppet valve is closed and the hollow interior of said poppet valve so that fluid pressure within said poppet valve cooperates with said main spring to maintain said poppet valve in its closed position, said poppet valve having a vent passage between its central boss means thereof and around the stem communicating with said flow path downstream from said valve seat, said vent passage formed as an annular spacing surrounding the stem and between the stem and said boss means central opening to provide a vented flow of fluid from within the poppet valve, said poppet valve further including a dump valve positioned within said said poppet valve and mounted upon a part of the stem extending within said poppet valve, said dump valve including a nut means and a valve member therebelow, said nut means having a central opening extending partially therein from its bottom thereof, there being an opening formed through the valve member, said stem extending through the valve member, and located at its upper end within the nut means opening, said dump valve being biased toward a closed position by the urging of said spring and fluid pressure upon the nut means and its associated valve member for blocking the said vent passage, said stem upon upward movement thereof, as through actuation of the handle, being operable to first move said dump valve and its nut means and its valve member from its closed position thereby to vent pressurized fluid from within said poppet valve and around the stem such that only the biasing force of the said spring maintains said poppet valve in its closed position, and said stem being further operable, after said fluid pressure within said poppet valve has been vented, to further move said poppet valve to open said first mentioned seal against the bias of said spring and allow flow of the fuel through the passage.

2. In a dispensing nozzle as set forth in claim 1 and further comprising a venturi disposed downstream from said valve seat, said venturi constituting a portion of said flow passage, a check valve disposed within said flow passage and being spring biased toward a closed position in which said check valve is engagable with a portion of said venturi so as to substantially prevent leakage of fluid out of said flow passage when said poppet valve is closed, said check valve being forced towards its open position by fluid pressure upon opening of said poppet valve, said venturi having a converging section facing upstream toward said valve seat, a throat, and a diverging downstream section, said check valve being sealingly engagable with said diverging section adjacent said throat and having a rounded end facing upstream of said check valve and further having a diameter only slightly larger than the diameter of said throat.

3. The invention of claim 1 wherein said stem carries a ring thereon and spaced downwardly from said poppet valve to provide opening of said dump valve into an open position prior to the exertion of any substantial force on the poppet valve to force it from its closed position towards its open position.

4. The invention of claim 1 and further including a flexible flow deflector fixably positioned within said flow passage, downstream from said valve seat, said flexible deflector including a washer means, having a central aperture therethrough, and having the stem located therethrough, and said flexible deflector being engagable by fluid flowing past said valve seat upon opening of said poppet valve thereby to minimize fluid flow turbulence.

* * * * *